United States Patent [19]

Ignatjev

[11] 4,096,544

[45] Jun. 20, 1978

[54] AIR IONIZER

[76] Inventor: Vladimir Ignatjev, 39 Ledgewood Dr., Norwalk, Conn. 06850

[21] Appl. No.: 749,173

[22] Filed: Dec. 9, 1976

[51] Int. Cl.[2] ..... H05F 3/06

[52] U.S. Cl. ..... 361/231; 361/235

[58] Field of Search ..... 361/230, 231, 233, 235

[56] References Cited

U.S. PATENT DOCUMENTS

| | | | |
|---|---|---|---|
| 2,765,975 | 10/1956 | Lindenbald | 361/230 |
| 3,138,740 | 6/1964 | Rich | 361/231 |
| 3,417,302 | 12/1968 | Lueder | 361/231 |
| 3,504,227 | 3/1970 | Wooton et al. | 361/231 |
| 3,515,548 | 6/1970 | Lange | 361/235 |
| 3,678,337 | 7/1972 | Grauvogel | 361/231 |
| 3,714,531 | 1/1973 | Takahashi | 361/230 |
| 3,873,835 | 3/1975 | Ignatjev | 361/230 |

*Primary Examiner*—Gerald Goldberg
*Attorney, Agent, or Firm*—Robert A. Green

[57] ABSTRACT

The air ionizer comprises a sealed insulating housing containing a high voltage power supply and a half-wave modifier. Conductive brushes or filamentary elements are provided on the outside surface of the housing and are coupled to the power supply, either resistively or capacitively, so that they generate ions in the surrounding air. Capacitive coupling is to a conductive layer on the inner surface of the housing.

15 Claims, 5 Drawing Figures

AIR IONIZER

BACKGROUND OF THE INVENTION

Air ionizers are widely used in industry to prevent electrostatic charge build-up and to neutralize existing charges. Ionizers are also used for therapeutic purposes to produce mostly negative ions which have a beneficial effect on respiratory diseases and allergies, perform a tranquilizing function, lower bacteria, and improve reaction time.

Known industrial ionizers use radioactive materials or alternating current corona discharge to produce positive and negative air ions. Radioactive ionizers, which are relatively weak, produce equal amounts of positive and negative ions. The alternating current corona discharge ionizers produce more negative than positive ions. The common corona discharge arrangement uses a needle point or a thin wire in close proximity to a grounded surface to produce a strong electric field. Ozone and nitrus oxides are generated as undesirable by-products.

U.S. Pat. No. 3,873,835 describes a combination of an electric fan and ion-producing carbon brushes. This device produces a draft and requires a slip ring to supply the high voltage to the rotating fan. U.S. Pat. No. 3,936,698 describes a method for producing the desired ion ratio by using two independent unipolar air ionizers of opposite polarity which are alternately energized for different periods of time. This approach is complicated and requires a fan for ion distribution.

For optimum therapeutic application, the amount of unipolar air ions inhaled must be controlled. The amount of bipolar ions is not as important as the ratio of positive to negative ions. The maximum beneficial effect can be achieved by simultaneous application of bipolar air ions having a ratio of less than one and an electric field of +500 to +1000 volts per meter. Both requirements are easily achieved by the present invention.

DESCRIPTION OF THE PREFERRED EMBODIMENTS

Figure 1:
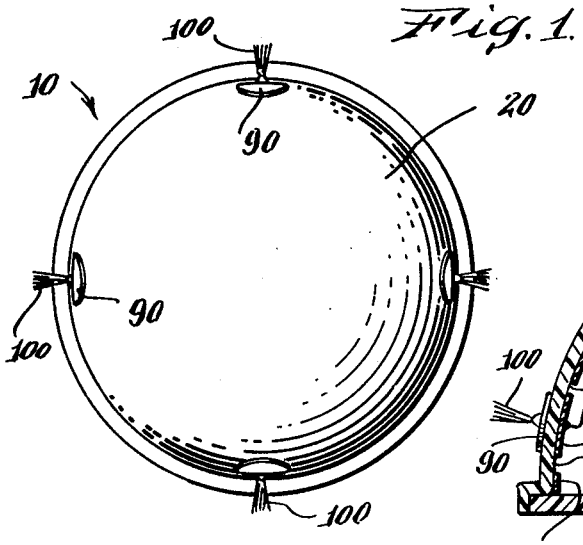
FIG. 1 is a plan view of an air ionizer embodying the invention.
Figure 2:
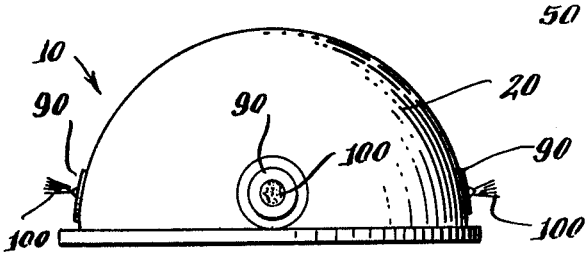
FIG. 2 is a side elevational view of the apparatus of FIG. 2.
Figure 3:
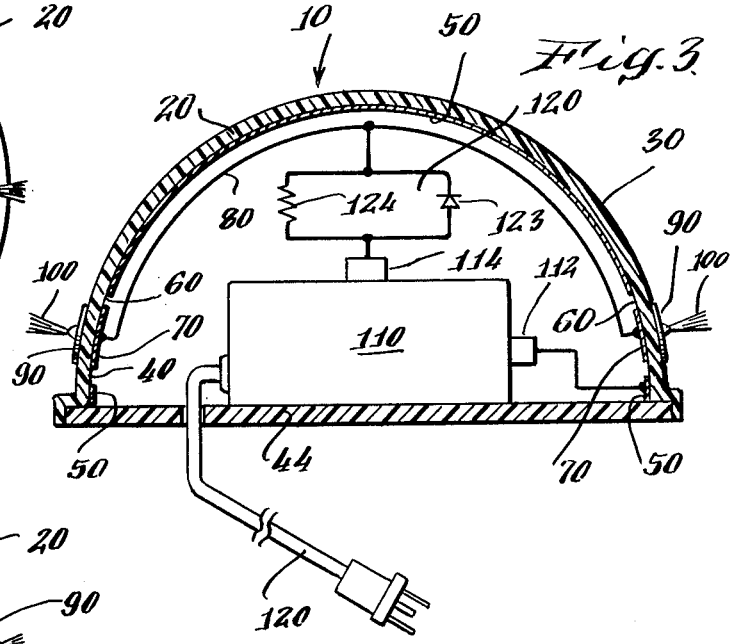
FIG. 3 is an elevational view, partly in section, of the apparatus of FIG. 1.

An air ionizer 10 embodying the invention, referring to FIGS. 1–3, comprises a hemispherical shell 20 made of insulating material, and having an outer surface 30 and an inner surface 40. The shell is seated on and secured to an insulating base 44. A conductive layer 50 having several holes 60 is provided on the inner surface 40 of the shell 20, and individual conductive layers or plates 70 are formed on the inner surface 40 within the holes 60 in layer 50. Layers 70 are insulated from layer 50, and they are interconnected by an insulated lead or wire 80. A plurality of conductive discs or plates 90, each carrying a plurality of conductive filamentary elements 100 are attached to the outer surface of the shell 20 aligned with the corresponding layers 70 and thus capacitively coupled thereto. As seen in FIG. 1, the plates 90 and their conductive filaments 100 are spaced apart on the outer surface of the shell. The area of the plates 90 and the filaments 100 may be about one square inch.

The ionizer 10 includes a high voltage power supply 110 which is mounted, for safety, inside the shell 30 and on the base 44 and has its electrical line cord 120 running through the base. The line cord provides line voltage and ground for the high voltage power supply which preferably has an alternating current output at terminal 114 of about 4000 volts RMS and a direct current output at terminal 112 of about 5600 volts. A half-wave modifier or signal modifying circuit 120, made up of a diode 132 and a resistor 124 in parallel, is connected between the A.C. output terminal 114 of the power supply and all of the layers 70 so that the A.C. output of the power supply, modified by circuit 120, is coupled to these layers, D.C. terminal 112 is connected to conductive layer 50.

In operation of the apparatus 10 of FIG. 3, conductive layers 70, together with the insulating shell 20 and the outer conductive discs 90, represent capacitors, and, with A.C. terminal 114 connected to them, they produce an alternating voltage on the conductive filamentary elements 100. The D.C. output terminal 112 connected to conductive layer 50 causes an external electric field to be generated. Both positive and negative air ions will be generated by corona discharge at the filaments 100, with the ratio of positive to negative ions being controlled by the half-wave modifier 120. Depending on the orientation of the diode 123 and the value of the resistor 124, more or fewer ions of one desired polarity could be produced. The diode 123 passes one unmodified half-wave of alternating current, and the other half-wave goes through the resistor and will experience a voltage drop, as is well known in the art. Those skilled in the art can readily adjust circuit 120 to achieve the desired type and density of ions generated.

Optimum generation and spread of ions is achieved by the interaction of the effect of the A.C. output connected through circuit 120 to plates 70 and filaments 100 with the effect of D.C. terminal 112 connected to layer 50 which generates an external electric field outside the ionizer.

Figure 4:
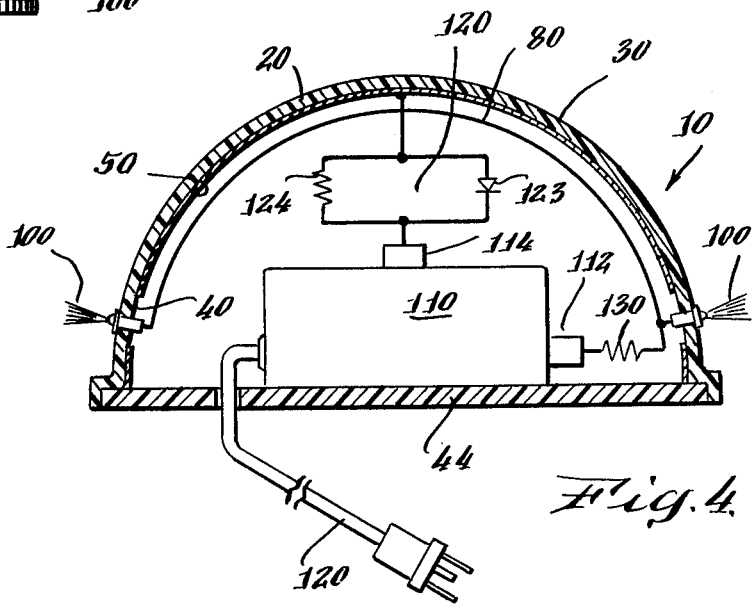
FIG. 4 is an elevational view, partly in section, of a modification of the invention.
Figure 5:
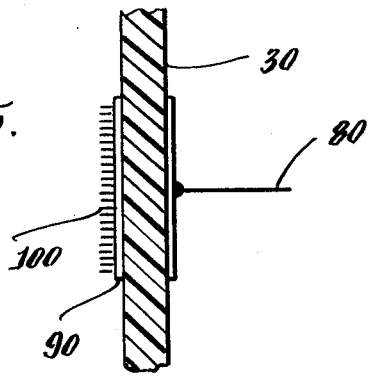
FIG. 5 is an enlarged sectional view of a portion of the apparatus of FIG. 1 showing a modification therein.

In a modification of the invention illustrated in FIG. 4, the ionizer 10 includes the same elements as the ionizer shown in FIGS. 1–3 except that conductive layers 70 in the holes in conductive layer 50 are omitted and the conductive plates 90 and filamentary elements 100 are connected through housing 20 (through holes 60 in conductive film 50) to wire 80 and thence to D.C. terminal 112 of the high voltage power supply through a resistor 130 (to prevent shock to the user). The alternating current output at terminal 114 is connected through the half-wave modifier 120 to the conductive inside layer 50.

As above, the filaments 100 generate ions, and these fill the space surrounding the ionizer to a favorable distance due to the interaction of the A.C. and D.C. fields.

It is noted that the filaments 100 are preferably of carbon to eliminate ozone.

The principles of the invention, disclosed above, will permit those skilled in the art to make modifications in the specific structures and circuits described above.

What is claimed is:

1. An air ionizer comprising a dome-shaped housing including a center shell of insulating material having an inner surface and an outer surface, a conductive layer on the inner surface of said shell having a plurality of apertures which expose said shell of insulating material, a plurality of first conductive plates seated on said insulating shell within said apertures but insulated from said conductive layer, a plurality of second conductive plates on said outer surface of said housing aligned with said holes in said conductive layer, and carrying a plurality of conductive filaments which extend into the atmosphere surrounding said housing, and a source of voltage within said housing having one output coupled to said first plates and thus to said conductive filaments whereby the air at said filaments is ionized, said voltage source having a second output coupled to said conductive layer.

2. The ionizer defined in claim 1 wherein said housing includes an insulating base and said power supply is supported on said base.

3. The apparatus defined in claim 1 wherein said housing is generally hemispherical in shape.

4. The apparatus defined in claim 1 wherein said voltage source has both an unsymmetrical A.C. output and a D.C. output which combine in their operation to generate a field of ions surrounding said ionizer.

5. The apparatus defined in claim 4 wherein said A.C. output is coupled to said filamentary elements, and said D.C. output is coupled to said conductive layer.

6. The apparatus defined in claim 4 wherein said A.C. output is coupled to said conductive layer, and said D.C. output is coupled to said filamentary elements.

7. The apparatus defined in claim 4 wherein said A.C. output is resistively coupled to said filimentary elements, and said D.C. output is resistively coupled to said conductive layer.

8. The apparatus defined in claim 4 wherein said A.C. output is coupled to said conductive layer, and said D.C. output is coupled through a resistive path to said filamentary elements.

9. The apparatus defined in claim 4 and including a parallel resistor-diode network connected to said A.C. output.

10. The apparatus defined in claim 1 wherein said filamentary elements are of carbon.

11. An air ionizer comprising a hollow dome-shaped housing shell made of insulating material, a conductive layer on the inner surface of said housing and having at least one aperture which exposes said shell, a hole through the shell within said aperture, an electric conductor within said hole, a plurality of conductive filamentary elements on the outside of said housing and connected to said conductor within said aperture, and a multi-output voltage source within said housing, the outputs being connected to ground, to said conductive layer, and to said conductor.

12. The apparatus defined in claim 11 wherein said voltage source has both a D.C. output and an A.C. output.

13. The apparatus defined in claim 12 wherein said D.C. output is coupled to said filamentary elements through a resistive path.

14. The apparatus defined in claim 12 wherein said A.C. output is connected to said inside layer and said D.C. output is connected to the filamentary elements.

15. The apparatus defined in claim 14 wherein the said A.C. output is coupled through a parallel resistor-diode network to said inside layer.

* * * * *